US010337366B2

(12) United States Patent
Kidooka et al.

(10) Patent No.: US 10,337,366 B2
(45) Date of Patent: Jul. 2, 2019

(54) INTERNAL COMBUSTION ENGINE AND METHOD OF ASSEMBLING THEREOF

(71) Applicant: TOYOTA JIDOSHA KABUSHIKI KAISHA, Toyota-shi, Aichi-ken (JP)

(72) Inventors: Akio Kidooka, Kanagawa-ken (JP); Yoshiaki Miyazato, Shizuoka-ken (JP); Keiju Tomoda, Susuno (JP); Masatoshi Sugiura, Nishio (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/884,475

(22) Filed: Jan. 31, 2018

(65) Prior Publication Data

US 2018/0283239 A1 Oct. 4, 2018

(30) Foreign Application Priority Data

Mar. 29, 2017 (JP) ..... 2017-065116

(51) Int. Cl.

| | |
|---|---|
| ***F01L 1/18*** | (2006.01) |
| ***F01L 13/00*** | (2006.01) |
| ***F01L 1/053*** | (2006.01) |
| ***F02F 7/00*** | (2006.01) |
| ***F01L 1/20*** | (2006.01) |
| *F02F 1/24* | (2006.01) |

(52) U.S. Cl.

CPC ..... *F01L 13/0026* (2013.01); *F01L 1/053* (2013.01); *F01L 1/18* (2013.01); *F01L 1/20* (2013.01); *F01L 13/0063* (2013.01); *F02F 7/006* (2013.01); *F01L 1/185* (2013.01); *F01L 2001/0535* (2013.01); *F01L 2105/00* (2013.01); *F02F 1/24* (2013.01); *F02F 2200/00* (2013.01)

(58) Field of Classification Search

CPC ..... F01L 1/18; F01L 1/185; F01L 13/0026; F01L 13/0063; F02F 1/24; F02F 7/006

USPC ..... 123/90.38, 90.39, 90.44

See application file for complete search history.

(56) References Cited

U.S. PATENT DOCUMENTS 9,631,668 B2 * 4/2017 Kizhakkethara ..... F16C 29/02 123/90.38

FOREIGN PATENT DOCUMENTS

JP 2008-190427 A 8/2008

* cited by examiner

*Primary Examiner* — Ching Chang

(74) *Attorney, Agent, or Firm* — Sughrue Mion, PLLC

(57) ABSTRACT

An internal combustion engine includes: a head cover covering a cylinder head; and a variable valve actuation mechanism. The variable valve actuation mechanism includes: a cam placed inside the head cover and rotating with a camshaft extending in a rotation axis direction; and an intermediate arm placed inside the head cover and sandwiched between the cam and a rocker arm. A pair of side through-holes, which are provided for a support rod supporting the intermediate arm to pass through, are formed in side portions of the head cover so as to face each other along the rotation axis direction.

4 Claims, 5 Drawing Sheets

INTERNAL COMBUSTION ENGINE AND METHOD OF ASSEMBLING THEREOF

BACKGROUND

Technical Field

The present disclosure relates to an internal combustion engine provided with an intermediate arm for transmitting force of a cam to a rocker arm, and a method of assembling thereof.

Background Art

Patent Literature 1 discloses a valve actuation mechanism of an internal combustion engine. The valve actuation mechanism rocks a rocker arm by rotating a camshaft and thereby opens and closes a valve. The camshaft and the rocker arm are placed inside a head cover covering a cylinder head. More specifically, the rocker arm is rotatably supported by a rocker shaft, and the rocker shaft and the camshaft are supported by the head cover.

When assembling the internal combustion engine, it is necessary to mount the head cover on the cylinder head. At this time, if rocker arms inside the head cover individually rotate, it is hard to mount the head cover. According to Patent Literature 1, in order to prevent such the rotation of the rocker arms, a rod member is passed through the rocker arms or the rocker arms are supported from below by a rod member when mounting the head cover on the cylinder head.

LIST OF RELATED ART

Patent Literature 1: Japanese Laid-Open Patent Publication No. 2008-190427

SUMMARY

Let us consider a case where a valve actuation mechanism of an internal combustion engine is a variable valve actuation mechanism. In this case, it is necessary to further use an "intermediate arm" that transmits force of a cam to a rocker arm. The intermediate arm is placed to be sandwiched between the cam and the rocker arm.

Unlike the cam and the rocker arm, the intermediate arm is not necessarily supported by a shaft. Therefore, when assembling the internal combustion engine, the intermediate arm may "fall" before being sandwiched between the cam and the rocker arm. In some cases, the intermediate arm is rotatably supported by a shaft. Even in that case, the intermediate arm is rotated by its own weight before being sandwiched between the cam and the rocker arm. In either case, assembly workability is not good.

An object of the present disclosure is to provide a technique that can improve workability of assembling an internal combustion engine provided with an intermediate arm for transmitting force of a cam to a rocker arm.

A first disclosure provides an internal combustion engine.

The internal combustion engine includes:

a head cover covering a cylinder head; and a variable valve actuation mechanism.

The variable valve actuation mechanism includes:

a cam placed inside the head cover and rotating with a camshaft extending in a rotation axis direction; and an intermediate arm placed inside the head cover and sandwiched between the cam and a rocker arm.

A pair of side through-holes, which are provided for a support rod supporting the intermediate arm to pass through, are formed in side portions of the head cover so as to face each other along the rotation axis direction.

A second disclosure has the following feature in addition to the first disclosure.

An arm through-hole, which is provided for the support rod to pass through, is formed to penetrate the intermediate arm in the rotation axis direction.

A third disclosure has the following feature in addition to the first or second disclosure.

The intermediate arm is rotatably supported by a control shaft extending in the rotation axis direction.

A fourth disclosure provides a method of assembling an internal combustion engine.

The internal combustion engine includes:

a head cover covering a cylinder head; and a variable valve actuation mechanism.

The variable valve actuation mechanism includes:

a cam placed inside the head cover and rotating with a camshaft extending in a rotation axis direction; and an intermediate arm placed inside the head cover and sandwiched between the cam and a rocker arm.

A pair of side through-holes are formed in side portions of the head cover so as to face each other along the rotation axis direction.

The method of assembling includes:

inserting a support rod into the head cover through the pair of side through-holes to support the intermediate arm with the support rod inside the head cover; and mounting the head cover on the cylinder head.

According to the first disclosure, the pair of side through-holes facing each other along the rotation axis direction are formed in the side portions of the head cover. When assembling the internal combustion engine, it is possible to insert a support rod into the head cover through the pair of side through-holes. It is possible to support the intermediate arm inside the head cover by using the support rod and thus to prevent the intermediate arm from falling or rotating. That is, when assembling the internal combustion engine, it is possible to prevent the intermediate arm from falling or rotating and thus to integrally handle the intermediate arm and the head cover. As a result, it becomes easy to mount the head cover on the cylinder head, and thus the assembly workability improves.

According to the second disclosure, the arm through-hole is formed to penetrate the intermediate arm in the rotation axis direction. Therefore, when assembling the internal combustion engine, it is possible to insert the support rod so as to pass through the arm through-hole of the intermediate arm. It is thus possible to certainly prevent the intermediate arm from falling or rotating.

According to the third disclosure, when assembling the internal combustion engine, it is possible to prevent the intermediate arm from rotating.

According to the fourth disclosure, when assembling the internal combustion engine, the support rod is inserted into the head cover through the pair of side through-holes formed in the side portions of the head cover. Then, the intermediate arm is supported by the support rod inside the head cover. Therefore, it is possible to prevent the intermediate arm from falling or rotating and thus to integrally handle the intermediate arm and the head cover. As a result, it becomes easy to mount the head cover on the cylinder head, and thus the assembly workability improves.

EMBODIMENTS

Embodiments of the present disclosure will be described below with reference to the attached drawings.

1. First Embodiment

Figure 1:
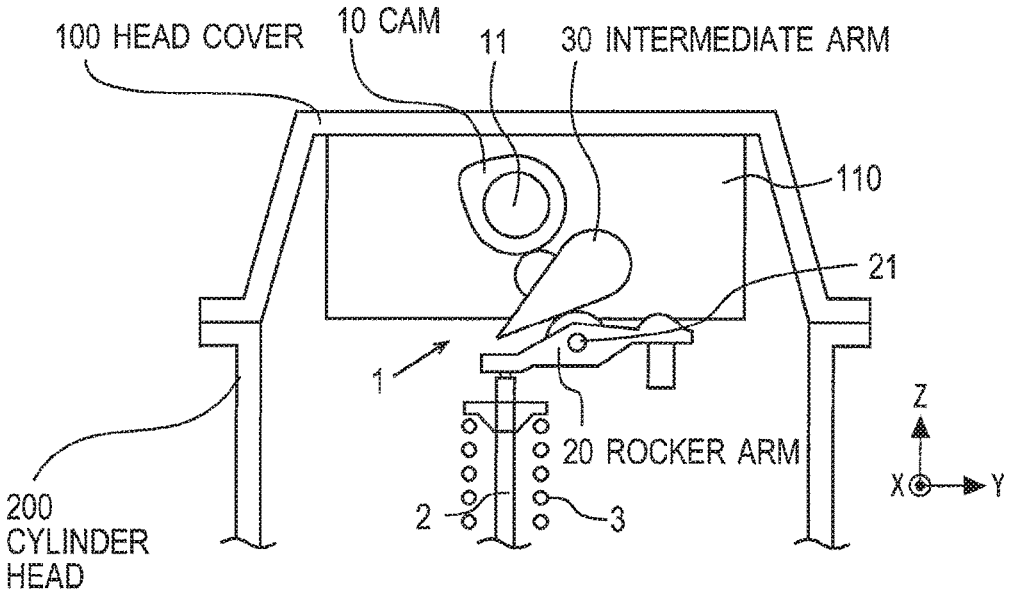
FIG. 1 is a cross-sectional diagram schematically showing a structure of an internal combustion engine according to a first embodiment of the present disclosure.

FIG. 1 is a cross-sectional diagram schematically showing a structure of an internal combustion engine according to a first embodiment of the present disclosure. The internal combustion engine includes a variable valve actuation mechanism 1. The variable valve actuation mechanism 1 is a mechanism for opening and closing a valve (not shown). When the variable valve actuation mechanism 1 is adopted, it is possible to adjust opening/closing timings and a lift amount of the valve. As shown in FIG. 1, the variable valve actuation mechanism 1 includes a cam 10, a rocker arm 20, and an intermediate arm 30.

The cam 10 is provided on a camshaft 11. More specifically, the cam 10 is integrated with the camshaft 11 and rotates with the camshaft 11. Here, an "X-direction" is defined as a rotation axis direction of the cam 10 and the camshaft 11, that is, an extending direction of the camshaft 11. The camshaft 11 extends in the X-direction and rotates about the X-axis as a rotation axis. Due to the rotation of the camshaft 11, the cam 10 also rotates about the X-axis as a rotation axis. It should be noted that although only one cam 10 is illustrated in FIG. 1, there are actually a plurality of cams 10 that are arranged along the X-direction apart from each other.

The rocker arm 20 is a part that rocks to open and close the valve. More specifically, the rocker arm 20 is rotatably supported by a rocker shaft 21. The rocker shaft 21 also extends in the X-direction. One end of the rocker arm 20 is connected to the valve through a valve stem 2. The valve is biased in a valve-closing direction by a valve spring 3. The rocker arm 20 rocks around the rocker shaft 21, and thereby the valve opens and closes.

The intermediate arm 30 is a part for transmitting force of the cam 10 to the rocker arm 20. For that purpose, the intermediate arm 30 is placed to be sandwiched between the cam 10 and the rocker arm 20. Although only one intermediate arm 30 is illustrated in FIG. 1, there are actually a plurality of intermediate arms 30 that are arranged along the X-direction apart from each other to be respectively associated with the plurality of cams 10.

The intermediate arm 30 rocks due to the rotation of the cam 10, and the rocker arm 20 rocks due to the rocking of the intermediate arm 30. That is, a pushing force generated by the rotation of the cam 10 is transmitted to the rocker arm 20 through the intermediate arm 30. It should be noted that a rocking range of the intermediate arm 30 is variable and adjustable. The opening/closing timings and the lift amount of the valve can be adjusted by adjusting the rocking range of the intermediate arm 30. Various methods have been proposed as a mechanism for adjusting the rocking range of the intermediate arm 30. In the present embodiment, the mechanism is not particularly limited.

The internal combustion engine further includes a head cover 100 and a cylinder head 200. The head cover 100 is installed so as to cover the cylinder head 200. In FIG. 1, a Z-direction is a direction from the cylinder head 200 towards the head cover 100, and a Y-direction is a direction perpendicular to the above-mentioned X-direction and Z-direction.

The variable valve actuation mechanism 1 is placed in a space formed by the head cover 100 and the cylinder head 200. More specifically, the cam 10, the camshaft 11, and the intermediate arm 30 are placed inside the head cover 100. The camshaft 11 is supported by the head cover 100. The camshaft 11 may be placed so as to penetrate a journal 110 formed inside the head cover 100. The valve, the rocker arm 20, and the rocker shaft 21 are placed inside the cylinder head 200.

Next, let us consider assembling the internal combustion engine shown in FIG. 1. For example, the parts shown in FIG. 1 may be stacked in order. More specifically, first, the cylinder head 200 in which the valve and the rocker arm 20 are placed is prepared. Subsequently, the intermediate arm 30 is placed on the rocker arm 20. Then, the cam 10 and the camshaft 11 are placed on the intermediate arm 30. Finally, the head cover 100 is placed. However, in the case of this method, the number of work processes is large and the time required for working becomes long.

Figure 2:
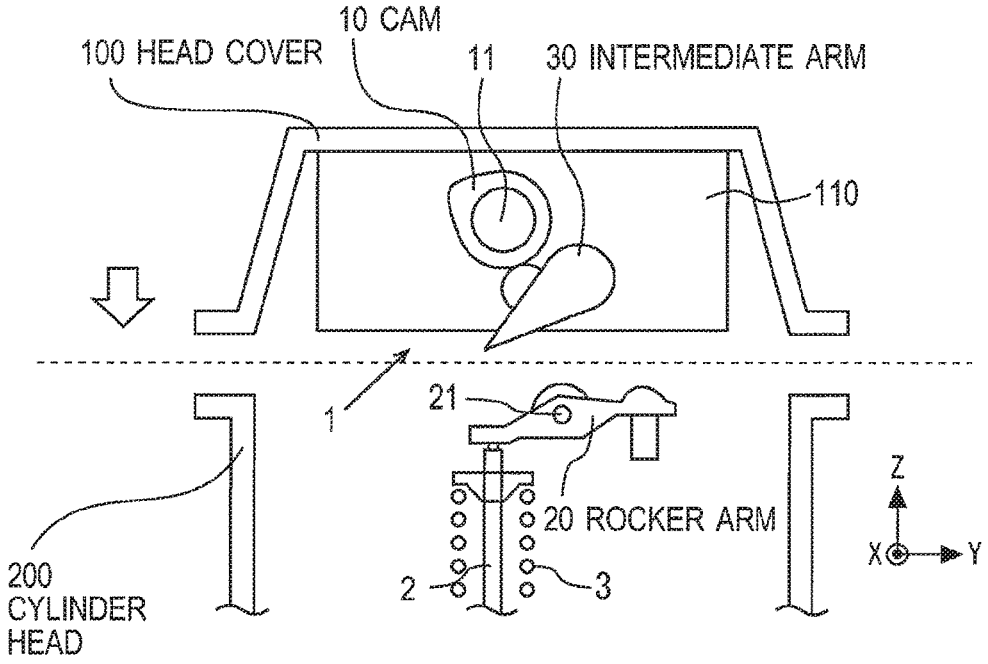
FIG. 2 is a cross-sectional diagram for explaining assembly of the internal combustion engine according to the first embodiment of the present disclosure.

In view of the above, according to the present embodiment, the head cover 100 and the parts placed on the side of the head cover 100 are unitized as shown in FIG. 2. In other words, the head cover 100 and the parts placed on the side of the head cover 100 are handled integrally. In this case, when assembling the internal combustion engine, it is enough to just mount the unitized head cover 100 on the cylinder head 200, which can reduce the number of work processes and the time required for working.

It should be noted here that unlike the cam 10 and the rocker arm 20, the intermediate arm 30 is not necessarily supported by a shaft. When not supported by a shaft, the intermediate arm 30 is supported only by being sandwiched between the cam 10 and the rocker arm 20. When assembling the internal combustion engine with that structure, there is a possibility that the intermediate arm 30 "falls" off the head cover 100. That is, when mounting the head cover 100 on the cylinder head 200, the intermediate arm 30 may fall before being sandwiched between the cam 10 and the rocker arm 20. When the intermediate arm 30 easily falls, it is hard to mount the head cover 100 on the cylinder head 200, and thus assembly workability deteriorates.

In view of the above, the present embodiment proposes a technique that can prevent the intermediate arm 30 from falling when assembling the internal combustion engine.

Figure 3:
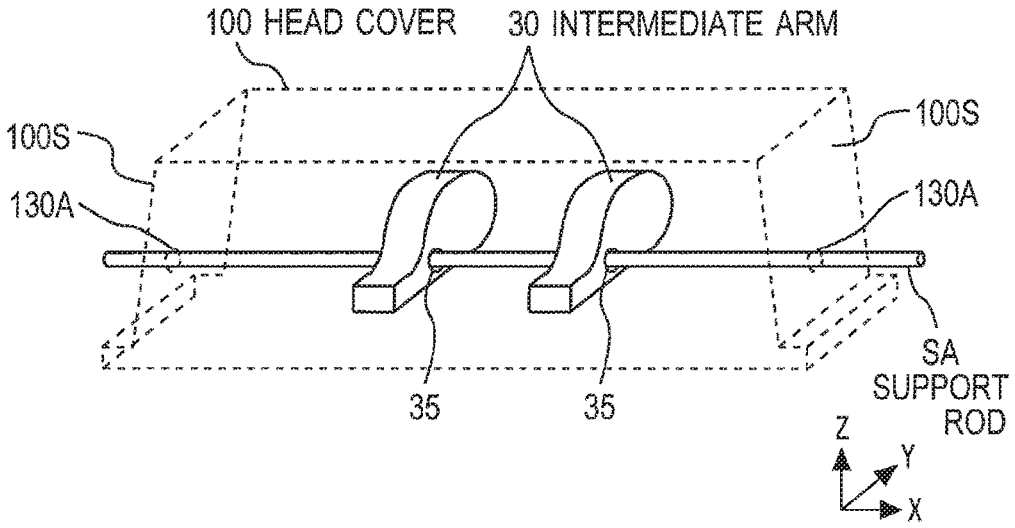
FIG. 3 is a schematic diagram showing a head cover when assembling the internal combustion engine according to the first embodiment of the present disclosure.

FIG. 3 is a schematic diagram showing the head cover 100 when assembling the internal combustion engine according to the present embodiment. As shown in FIG. 3, a support rod SA (rod member) is used for preventing the intermediate arm 30 from falling. More specifically, the support rod SA is inserted into the head cover 100 along the X-direction so as to penetrate the plurality of intermediate arms 30.

To that end, a side through-hole 130A which is used for the support rod SA to pass through is formed in a head cover side portion 100S being a side portion of the head cover 100. More specifically, a pair of side through-holes 130A facing each other along the X-direction are respectively formed in the head cover side portions 100S. Furthermore, each intermediate arm 30 is provided with an arm through-hole 35 penetrating the intermediate arm 30 in the X-direction. The support rod SA is inserted into the head cover 100 along the X-direction so as to pass through the pair of side through-holes 130A and the arm through-hole 35 of each intermediate arm 30. When the support rod SA is inserted, the pair of side through-holes 130A and the arm through-hole 35 of each intermediate arm 30 align along the X-direction.

As described above, when assembling the internal combustion engine, the intermediate arm 30 inside the head cover 100 is supported by the support rod SA penetrating the intermediate arm 30. The support rod SA passes through the pair of side through-holes 130A of the head cover 100 and is supported by the head cover 100. Therefore, when assembling the internal combustion engine, it is possible to certainly prevent the intermediate arm 30 from falling and thus to integrally handle the intermediate arm 30 and the head cover 100. As a result, it becomes easy to mount the unitized head cover 100 on the cylinder head 200, and thus the assembly workability improves.

It should be noted that after the head cover 100 is mounted on the cylinder head 200, the support rod SA is pulled out of the head cover 100. Even after the support rod SA is pulled out, the pair of side through-holes 130A of the head cover 100 and the arm through-hole 35 of each intermediate arm 30 remain.

2. Second Embodiment

Figure 4:
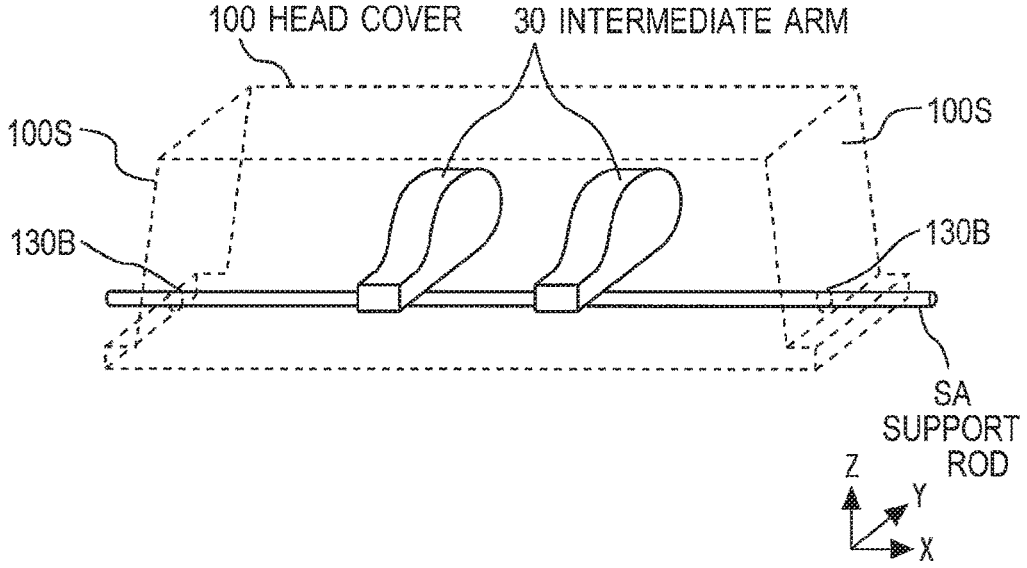
FIG. 4 is a schematic diagram showing a head cover when assembling the internal combustion engine according to a second embodiment of the present disclosure.

FIG. 4 is a schematic diagram showing the head cover 100 when assembling the internal combustion engine according to a second embodiment of the present disclosure. Description overlapping the first embodiment will be omitted as appropriate.

According to the second embodiment, the support rod SA supports the intermediate arm 30 from below instead of penetrating the intermediate arm 30. Therefore, the arm through-hole 35 is not formed in the intermediate arm 30. A side through-hole 130B which is used for the support rod SA to pass through is formed in the head cover side portion 100S, as in the case of the first embodiment. More specifically, a pair of side through-holes 130B facing each other along the X-direction are respectively formed in the head cover side portions 100S. The support rod SA is inserted into the head cover 100 along the X-direction so as to pass through the pair of side through-holes 130B. The plurality of intermediate arms 30 are supported from below by the support rod SA.

As described above, when assembling the internal combustion engine, the intermediate arm 30 inside the head cover 100 is supported from below by the support rod SA. The support rod SA passes through the pair of side through-holes 130B of the head cover 100 and is supported by the head cover 100. Therefore, when assembling the internal combustion engine, it is possible to prevent the intermediate arm 30 from falling and thus to integrally handle the intermediate arm 30 and the head cover 100. As a result, it becomes easy to mount the unitized head cover 100 on the cylinder head 200, and thus the assembly workability improves.

3. Third Embodiment

Figure 5:
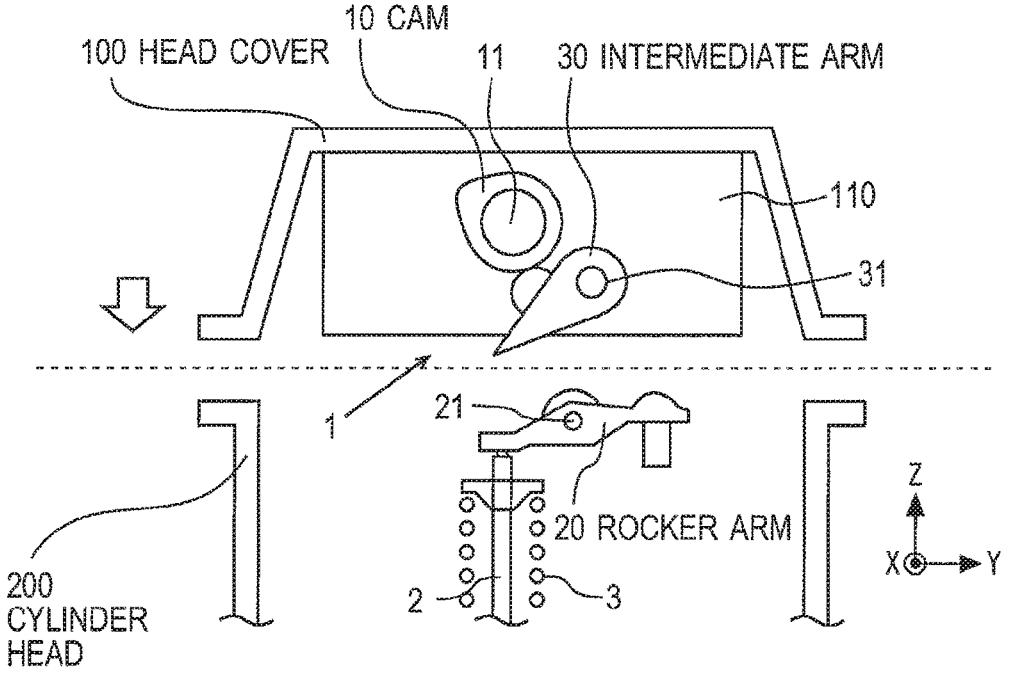
FIG. 5 is a cross-sectional diagram for explaining assembling the internal combustion engine according to a third embodiment of the present disclosure.

FIG. 5 is a cross-sectional diagram for explaining assembling the internal combustion engine according to a third embodiment of the present disclosure. Description overlapping the first embodiment will be omitted as appropriate.

According to the third embodiment, the intermediate arm 30 is rotatably supported by a control shaft 31. The control shaft 31 is parallel to the camshaft 11 and extends in the X-direction. The control shaft 31 is supported by the head cover 100. The control shaft 31 may be placed so as to penetrate the journal 110 formed inside the head cover 100.

Since the intermediate arm 30 is supported by the control shaft 31, the intermediate arm 30 does not fall when assembling the internal combustion engine. However, the intermediate arm 30 is rotated by its own weight before being sandwiched between the cam 10 and the rocker arm 20. When the intermediate arm 30 rotates, it is hard to mount the head cover 100 on the cylinder head 200, and thus assembly workability deteriorates.

In order to prevent the intermediate arm 30 from rotating, the above-described method as shown in FIG. 3 or FIG. 4 is still useful. That is, by inserting the support rod SA into the head cover 100 so as to penetrate the intermediate arm 30 as shown in FIG. 3, it is possible to certainly prevent the intermediate arm 30 from rotating. Alternatively, by inserting the support rod SA into the head cover 100 so as to support the intermediate arm 30 from below as shown in FIG. 4, it is possible to prevent the intermediate arm 30 from rotating. As a result, it becomes easy to mount the unitized head cover 100 on the cylinder head 200, and thus the assembly workability improves.

What is claimed is:

1. An internal combustion engine comprising:
- a head cover covering a cylinder head; and
- a variable valve actuation mechanism,
- wherein the variable valve actuation mechanism comprises:
- a cam placed inside the head cover and rotating with a camshaft extending in a rotation axis direction; and
- an intermediate arm placed inside the head cover and sandwiched between the cam and a rocker arm,
- wherein a pair of side through-holes, which are provided for a support rod supporting the intermediate arm to pass through, are formed in side portions of the head cover so as to face each other along the rotation axis direction.

2. The internal combustion engine according to claim 1, wherein an arm through-hole, which is provided for the support rod to pass through, is formed to penetrate the intermediate arm in the rotation axis direction.

3. The internal combustion engine according to claim 1, wherein the intermediate arm is rotatably supported by a control shaft extending in the rotation axis direction.

4. A method of assembling an internal combustion engine, the internal combustion engine comprising:
- a head cover covering a cylinder head; and
- a variable valve actuation mechanism,
- wherein the variable valve actuation mechanism comprises:
- a cam placed inside the head cover and rotating with a camshaft extending in a rotation axis direction; and
- an intermediate arm placed inside the head cover and sandwiched between the cam and a rocker arm,
- wherein a pair of side through-holes are formed in side portions of the head cover so as to face each other along the rotation axis direction, the method of assembling comprising:

inserting a support rod into the head cover through the pair of side through-holes to support the intermediate arm with the support rod inside the head cover; and mounting the head cover on the cylinder head.

* * * * *